US006332836B1

(12) United States Patent
Tseng

(10) Patent No.: US 6,332,836 B1
(45) Date of Patent: Dec. 25, 2001

(54) GRINDING WHEEL ASSEMBLY

(76) Inventor: Ming-Xin Tseng, No. 38-11, 10th Neighborhood, Jungieng Li, Yuanli Jen, Miaoli (TW)

( * ) Notice: Subject to any disclaimer, the term of this patent is extended or adjusted under 35 U.S.C. 154(b) by 0 days.

(21) Appl. No.: 09/822,239

(22) Filed: Apr. 2, 2001

(51) Int. Cl.[7] ..... B23F 21/03; B23F 21/23

(52) U.S. Cl. ..... 451/359; 451/540; 451/548

(58) Field of Search ..... 451/350, 353, 451/359, 360, 540, 548, 550, 490, 496, 502, 510, 521, 342

(56) References Cited

U.S. PATENT DOCUMENTS 4,924,634 * 5/1990 Mackay, Jr. ..... 451/342
5,152,106 * 10/1992 Mackay, Jr. ..... 451/342
5,895,317 * 4/1999 Timm ..... 451/359
6,116,996 * 9/2000 Yanase ..... 451/359
6,264,408 * 7/2001 Lung et al. ..... 451/359

* cited by examiner

*Primary Examiner*—Derris H. Banks
(74) *Attorney, Agent, or Firm*—Rosenberg, Klein & Lee

(57) ABSTRACT

A grinding wheel assembly includes a grinding wheel having two recesses respectively defined in tow opposite surfaces thereof and a plurality of protrusions extending inward from a inner periphery of each of the two recesses. A first position member is received in one of the two recesses and has first notches for receiving the protrusions therein. A tubular section extend from the first position member and a polygonal section is located on the tubular section. A threaded rod extends from the polygonal section and through a hole of the wheel. A second position member is engaged with the other recess and has second notches for receiving the protrusions. The second position member has a polygonal hole which is engaged with the polygonal section.

1 Claim, 4 Drawing Sheets

GRINDING WHEEL ASSEMBLY

FIELD OF THE INVENTION

The present invention relates to a grinding wheel assembly wherein a powered shaft has two position members which are connected to two surfaces of the grinding wheel so as to prevent the wheel from being deformed.

BACKGROUND OF THE INVENTION

A conventional grinding wheel assembly is shown in FIG. 1 and generally includes a power mechanism 1' and a shaft 12' is connected to a lower end of the power mechanism 1'. A disk 11' is connected to the shaft 12' so that a grinding wheel 13' is connected to the disk 11'. The disk 11' is enclosed by the material of the grinding wheel 13' so that the disk 11' cannot be seen when the material of the grinding wheel 13' is connected to the disk 11'. The material of the grinding wheel 13' is consumable during using so that the size of the grinding wheel 13' becomes smaller and smaller. Because the disk 11' is made of metal or hard material so that if the disk 11' hits the object to be ground, the object will be damaged. Therefore, the user has to replace a new grinding wheel 13' when needed. However, because the disk 13' is not visible so that the user tends to discard the grinding wheel 13' before the disk 11' is exposed and this could result in waste. Besides, the diameter of the grinding wheel 13' is larger than the diameter of the disk 11' and the disk 11' is a thin disk which is deeply enclosed by the material so that the grinding wheel 13' is easily deformed.

The present invention intends to provide a grinding wheel assembly wherein the grinding wheel is clamped between two position members which is visible.

SUMMARY OF THE INVENTION

In accordance with one aspect of the present invention, there is provided a grinding wheel assembly and comprises a grinding wheel having a hole defined therein and two recesses are respectively defined in tow surfaces of the grinding wheel. A plurality of protrusions extend inward from a inner periphery of each of the two recesses. A first position member is received in one of the two recesses and has a plurality of first notches which receive the protrusions therein. A tubular section extends from the first position member and a polygonal section is located on the tubular section. A threaded rod extends from the polygonal section and through the hole and the tubular section is engaged with the hole. A second position member is engaged with the other recess and has a plurality of second notches defined therein so as to receive the protrusions in the recess. The second position member has a polygonal hole which is engaged with the polygonal section.

The primary object of the present invention is to provide a grinding wheel assembly wherein the two position members are located on two surfaces of the grinding wheel so that the users can easily decide the timing of discarding the grinding wheel.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
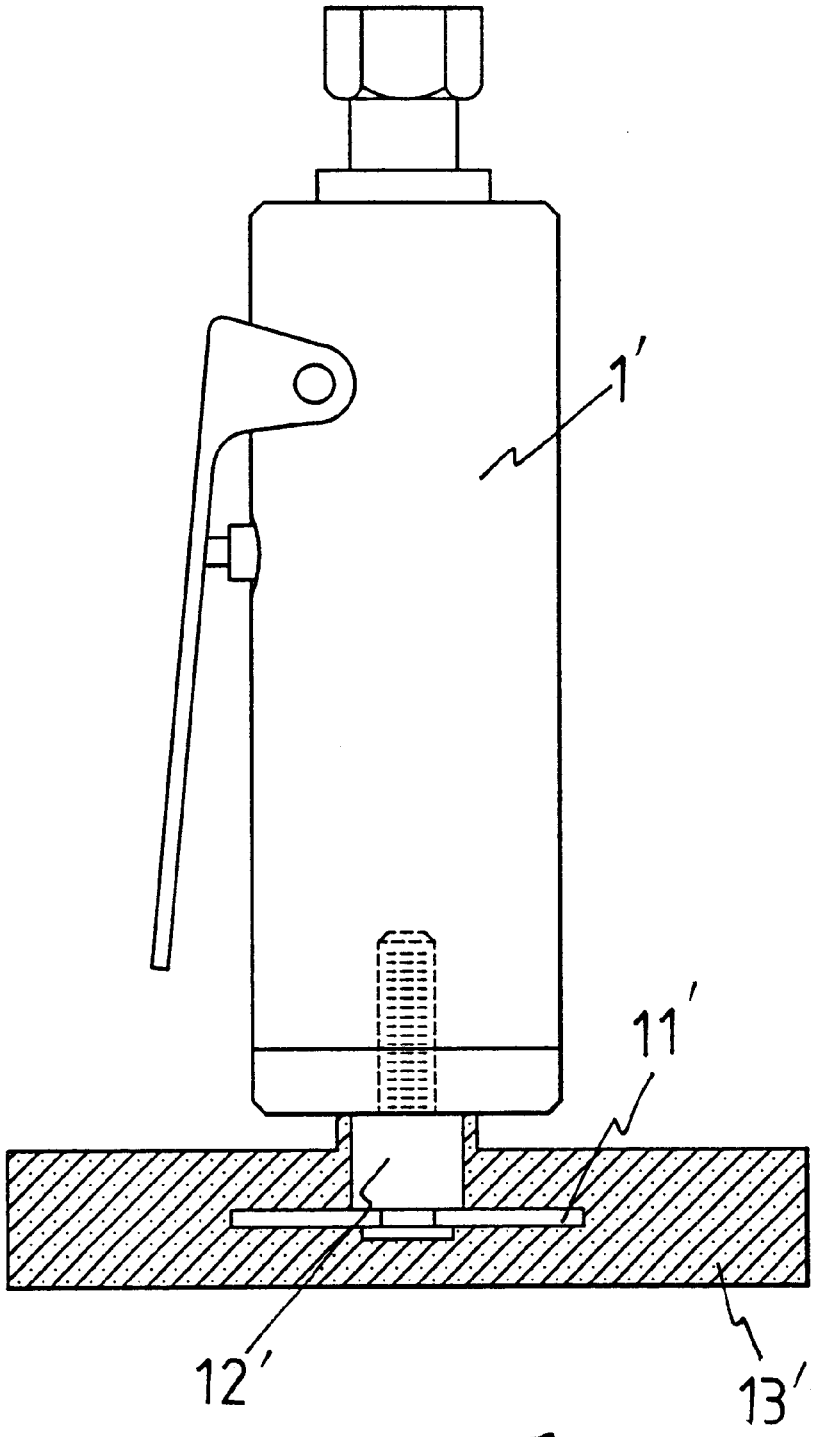
FIG. 1 PRIOR ART
FIG. 1 is a cross sectional view to show a conventional grinding wheel of the present invention.
Figure 2:
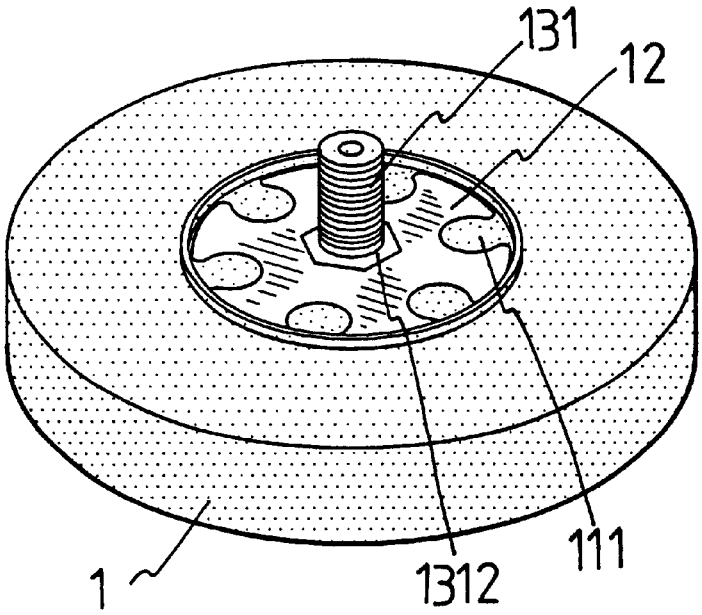
FIG. 2 is a perspective view to show the grinding wheel assembly of the present invention.
Figure 4:
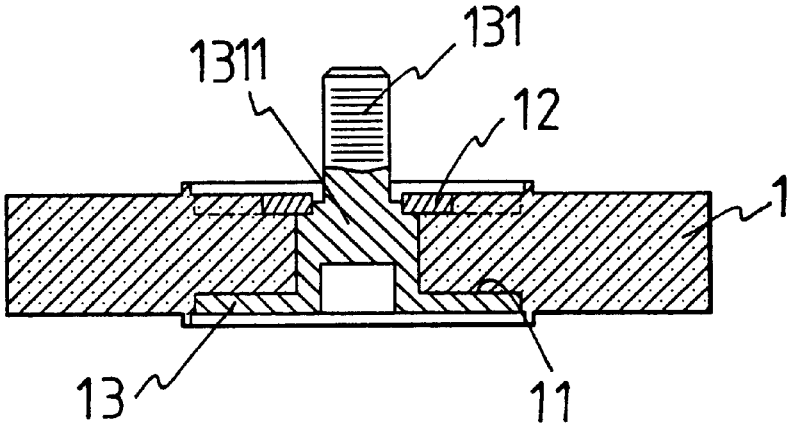
FIG. 4 is a cross sectional view to show the grinding wheel assembly of the present invention.
Figure 3:
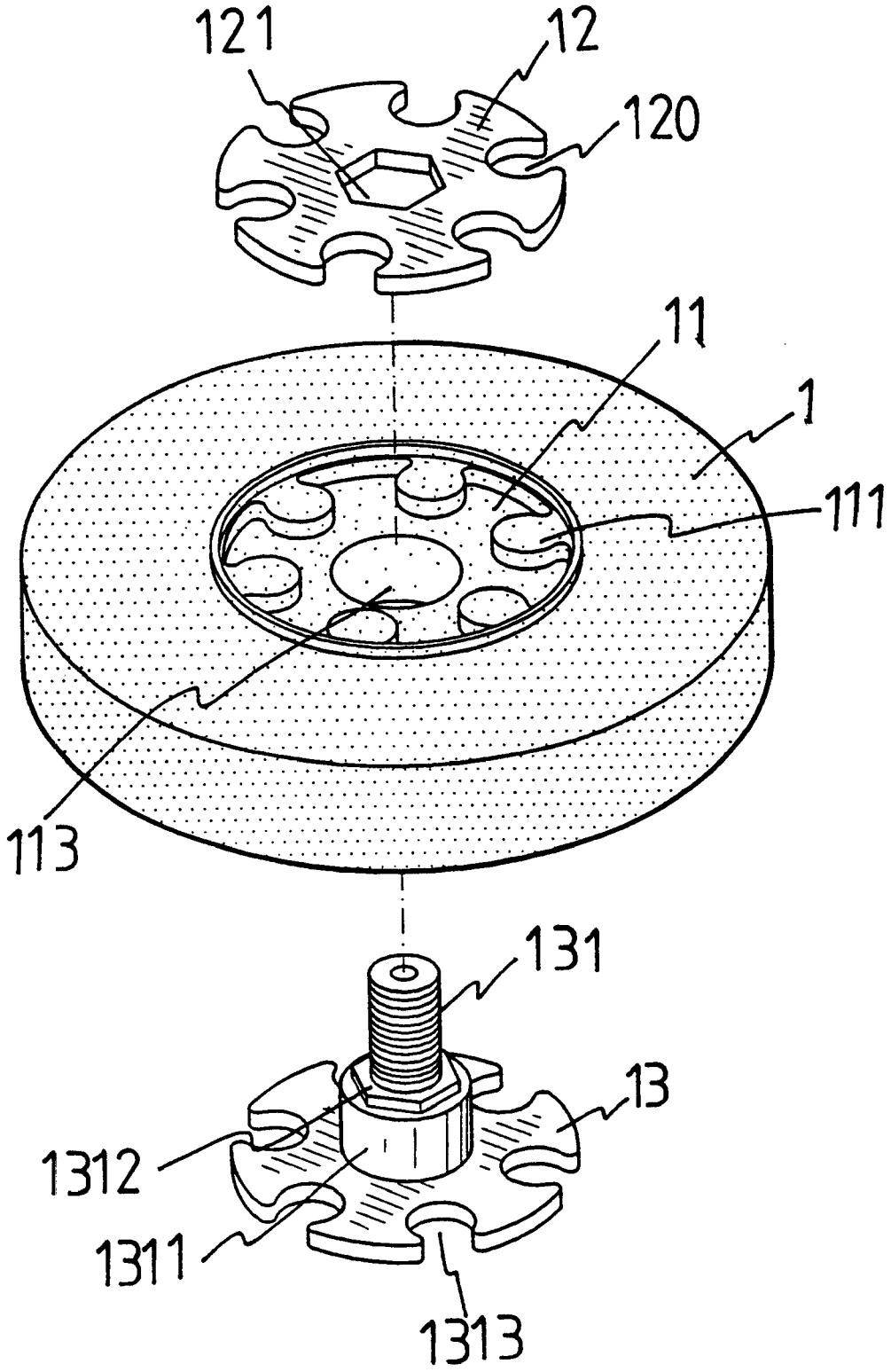
FIG. 3 is an exploded view to show the grinding wheel assembly of the present invention.

Referring to FIGS. 2 to 4, the grinding wheel assembly of the present invention comprises a grinding wheel 1 having a hole 113 defined centrally therein and two recesses 11 are respectively defined in tow opposite surfaces of the grinding wheel 1. The hole 113 is located at a center point of each of the recesses 11. A plurality of protrusions 111 extend inward from a inner periphery of each of the two recesses 11.

A first position member 13 is received in one of the two recesses 11 and has a plurality of first notches 1313 which receive the protrusions 111 therein. A tubular section 1311 extends from the first position member 13 and is engaged with the hole 113 in the grinding wheel 1. A hexagonal section 1312 is located on the tubular section 1311 and a threaded rod 131 extends from the hexagonal section 1312. The threaded rod 131 extends through the hole 113.

A second position member 13 is engaged with the other recess 11 and has a plurality of second notches 120 defined therein so as to receive the protrusions 111 in the recess 11. The second position member 13 has a hexagonal hole 121 which is engaged with the polygonal section 1312.

Figure 5:
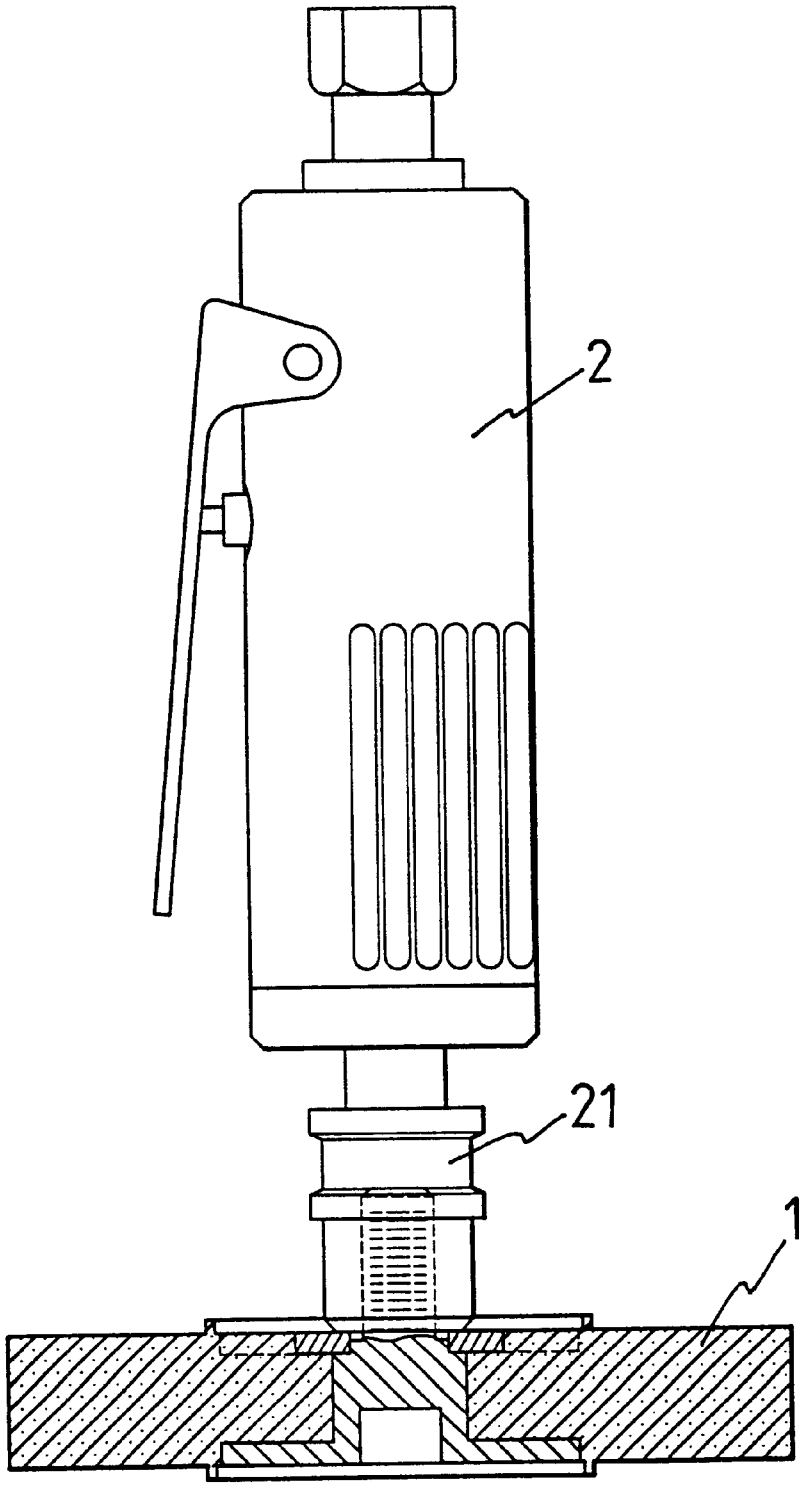
FIG. 5 is a cross sectional view to show a power tool is connected to the grinding wheel assembly of the present invention.

Further referring to FIG. 5, a power tool 2 has a shaft 21 which is threadedly connected to the threaded rod 131. The grinding wheel 1 is held firmly and the tool is rotated to connect the threaded rod 131. Because the two position members 12 and 13 are securely engaged with the protrusions 111, and the second position member 12 is securely connected to the hexagonal section 1312, so that the connection of the grinding wheel 1 and the tool is completed within a short period of time.

Because the two position members 12, 13 are visible so that the user is clearly acknowledged when the material of the grinding wheel 1 is consumed to a replacement level. The grinding wheel 1 is also be securely clamped by the two position members 12, 13 so that it is not to be deformed.

While we have shown and described various embodiments in accordance with the present invention, it should be clear to those skilled in the art that further embodiments may be made without departing from the scope of the present invention.

What is claimed is:

1. A grinding wheel assembly comprising:

a grinding wheel having a hole defined therein and two recesses respectively defined in tow surfaces of said grinding wheel, a plurality of protrusions extending inward from a inner periphery of each of said two recesses;

a first position member received in one of said two recesses and having a plurality of first notches which receive said protrusions therein, a tubular section extending from said first position member and a polygonal section located on said tubular section, a threaded rod extending from said polygonal section and extending through said hole and said tubular section engaged with said hole, and a second position member engaged with the other recess and having a plurality of second notches defined therein so as to receive said protrusions in said recess, said second position member having a polygonal hole which is engaged with said polygonal section.

* * * * *